US006778086B2

(12) United States Patent
Morrone et al.

(10) Patent No.: US 6,778,086 B2
(45) Date of Patent: Aug. 17, 2004

(54) OPEN WINDOW SECURITY LOCK

(76) Inventors: Gerald Angelo Morrone, 718 Fifth St., Verona, PA (US) 15147; Louis Samuel Tedesco, 14 N. Joslyn Dr., Pittsburgh, PA (US) 15235

( * ) Notice: Subject to any disclaimer, the term of this patent is extended or adjusted under 35 U.S.C. 154(b) by 0 days.

(21) Appl. No.: 10/136,623

(22) Filed: May 2, 2002

(65) Prior Publication Data

US 2003/0206103 A1 Nov. 6, 2003

(51) Int. Cl.[7] ..... G08B 13/08

(52) U.S. Cl. ..... 340/546; 340/541; 340/545.1; 340/545.7; 200/61.71; 200/61.73; 200/61.76; 200/61.93; 116/86

(58) Field of Search ..... 340/546, 545.1, 340/547, 541, 545.7, 545.6, 686.1, 545.8, 545.9, 550; 200/61.73, 61.93, 61.71, 61.76, 61.81; 116/67 R, 77, 75, 86

(56) References Cited

U.S. PATENT DOCUMENTS 4,559,528 A * 12/1985 Davis ..... 340/566
4,862,141 A * 8/1989 Jordal ..... 340/521
4,888,578 A * 12/1989 Conemac ..... 340/546
4,896,139 A * 1/1990 Eldridge ..... 340/546
5,022,340 A * 6/1991 Caraba
5,552,768 A * 9/1996 Mikiel et al. ..... 340/546
5,872,514 A * 2/1999 Neas ..... 340/545.1
6,075,440 A * 6/2000 Carroll ..... 340/546
6,388,572 B1 * 5/2002 Salter ..... 340/546
6,542,078 B2 * 4/2003 Script et al. ..... 340/545.1

* cited by examiner

*Primary Examiner*—Davetta W. Goins

(57) ABSTRACT

An open window security lock consisting of a staff having a suction cup for attachment of the staff to the window which allows a sliding window sash to open a small amount for ventilation but not opening enough to admit an intruder. The staff upper end has a switch to sound an alarm if the upper end is moved away from touching the fixed upper frame. An alarm switch can be a displacement detector, motion detector or vibration detector. The staff length is adjustable. A length clamping can be a detent button, staff wall set screw, metal collar with a set screw, hose clamp, or an eccentrically pinned lever. The alarm may include wireless transmitter communicating with a wireless receiver.

10 Claims, 3 Drawing Sheets

11
12
33
30
36
39
38
37

11
12
36

11
12
42
41
40

11
12
45
44
43

33
34
12
35
30

31

32

OPEN WINDOW SECURITY LOCK

BACKGROUND OF THE INVENTION

1. Field of the Invention

This invention relates to security devices and more particularly, relates to a portable device for locking the position of a sliding window and the like.

2. Background Information

Frequently and from time to time the news media have stories of persons who are victimized by criminals making forced entry through sliding glass windows and door, that being especially tragic when the victim is a child or an infant in a bed room sleeping at night. The precaution of keeping a window locked works an acute discomfort on a hot summer night when it is especially inviting to open at least partially a ventilating aperture in the window. One of the great merits of the instant invention, subject of petition for patent, is that a sliding window can be locked against forced entry and still be locked in a partially opened position that will prevent entry by a person.

The invention provide for a lock in a partially opened position. Often a person would like to have a sliding window partially open to have air circulate, but this can sometimes be dangerous.

In a recently reported case in California, a child of age seven was kidnapped while sleeping and after a community wide search for several days the brutalized body was found in a distant grave. The community environment appears to become increasingly of a threat to those without secured building protection.

Devices to lock sliding doors and windows in the open position come in a variety of designs. One such devices attaches to the door and has a pin that fits a socket. However, this requires a modification of the door and window and is a permanent installation. Few, if any, doors and windows are provided with such locks.

A rod, stick or shaft can sometimes be placed in the track of the window to prevent the window from opening, but such a device is inconvenient to keep and use. This invention offers the following advantages over the simple rod, stick, or shaft:

The present invention can not be dislodged by a wire tool that could slip through a ventilating partial opening and thereby permitting the blocking stick to be dislodged. The instant invention can sound an alarm which is not a feature of the simple rod, stick, or shaft.

PRIOR ART

This invention is distinguished from U.S. Pat. No. 5,552,768 of inventors Mikiel and Usevitch in the following particulars: Patent 768 has its blocking force generated by a force vector exerted against the window glass, generated by a wedging action. The present invention places the load axially along the staff acting as a compression column with the load vector between the sash frame which is not glass and the total window frame which is not glass, all of which makes for a less fragile operating structure.

Moreover, this invention has utilitarian value that is neither claimed nor disclosed by said U.S. Pat. No. 5,552,768 or any other prior art in the following particulars:

The instant invention has all the merits cited in patent 768 as improvements over any other prior art plus the additional feature of not being dependent on fragile glass as the principal load force resistance origin. Also the instant invention permits resetting the opening aperture by releasing a detent or clamping means and sliding the shaft in or out further as contrasted with the requirement to reset the suction cup of patent 768.

OBJECT OF THE INVENTION

It is therefore one object of the present invention to provide a simple, easy to use device that can lock a sliding glass window and the like in a partially open position of variable user chosen position.

Another object of the present invention is to provide a staff of adjustable or selected length that can be fastened to a surface to lock a sliding window.

Another object of the present invention is to provide a portable window locking device comprised of a staff having a suction cup for mounting the device on a flat window surface to intercept a sliding glass window to prevent its opening beyond a selected fixed value.

Another object of the present invention is to provide a portable window locking device having a built-in alarm.

Another object of the present invention is to provide a portable window locking device having an audible alarm mounted on a surface, and including electric contacts that activate the alarm when attempts are made to force a sliding window or door open.

Another object of this invention is to provide integrated, total building security protection system using as a core, starting point means a device attached to a barrier window glass and such that functional service features can be added incrementally.

Another object of this invention is to use said starting point means as a signal input source, as a signal output means, as a stored energy source, as a solar energy collection means, using any one such means independently or in coordination as singular or multiple features of the aggregate at a window station location.

BRIEF DESCRIPTION OF THE INVENTION

The purpose of the present invention is to provide a portable sliding window locking device that is easy to transport and use.

The portable locking device, for sliding windows and the like, solves the problem of unauthorized access by providing a blocking staff held in position by a suction cup, the staff being positioned between the sliding window frame and the immobile window frame. The device includes a resilient suction cup or other easy release fastener for securely mounting the device on a vertical glass surface. The device is mounted by pressing the suction cup, which may be pre-moistened to improve adherence, to the surface of a window adjacent to the frame of the open window.

The mobile frame (sash) of the window will then come to a stop against the end of the portable sliding window lock staff between the fixed window perimeter frame and the moving sash. Any attempt by an intruder to force the window open is solidly blocked by the column staff.

The sliding window lock is light in weight. It is readily portable such that if the device owner has occasion to move to a different house or has occasion to wash the window then the shift is readily removed. In one specific embodiment of the invention a large mushroom-shaped suction cup is attached to the invention staff with adjustable leg so as to adapt to different window pane inset dimensions. The suction cup is provided with a small tab on one edge allowing the device to be easily and quickly removed in an emergency. A quick pull on the small tab releases the vacuum between the suction cup allowing it to be easily dislodged. Also, preferably, the suction cup is located near the top end of the staff when the staff is hung vertically. In such an arrangement just one suction cup could be sufficient to practice the invention.

It appears that a suction cup of polyurethane elastomer would perform well. It has been observed that a decorative window piece hung with such a suction cup on an outside window exposed to full daylight is after 10 years still performing its weight holding support task quite well.

A feature of the device is its use of the polyurethane elastomer which allows it to be made in various colors to suit all tastes. It can be made clear as well as in attractive neon colors. The bright neon colors can also help make it clearly visible as a warning to a would-be criminal. It can also be made of a wood tone to match wooden window frames. The polyurethane elastomer suction cup provides resilience and flexibility.

Since most sliding glass windows and sliding doors do not provide locks for holding the window when the window is partially opened, a person can feel comfortable and safe with this device in use. It can be used on many different sizes of windows. It can be applied at one side or centrally located on a window surface. Wherever it is applied to a surface of a window and securely attached with the suction cup, it establishes the position where the window frame will stop. It sets the window opening position allowing the window to be left slightly ajar for air circulation or allowing a pet to exit at night without the window being open any wider than the user desires.

Its unique design and portability allow many and varied uses of the portable sliding window lock. Travelers can use it to secure hotel room windows, recreational vehicle (RV) owners can use it for extra security of their windows. These are just a few of the possible uses. It can also be made longer for large windows or sliding doors.

An optional, but preferred embodiment of the invention, is to include an audible alarm in the device to detect and alert an occupant when an intruder is trying to force open the window. In this embodiment, a battery-powered audible alarm is securely attached to the sliding glass window lock. The audible alarm, which can be a whistle, siren or any other type of audible alarm, is activated by a electric switch on the staff of the sliding window lock. A spring loaded push button electric switch on the end of the staff is normally held open by pressing against window peripheral frame. Any movement of the normally set position of a sliding window frame releases the spring loading such as to close the electric switch and activate the alarm. The movement against a partially opened lower sash would cause the electric switch to close as the upper sash is moved downward. The net effect is still to maintain a restricted aperture too small for human entry.

Location of the electric contacts can vary. The switching means, if of motion sensor design, can be placed anywhere on the staff. Some reed electric switches are opened or closed by movement of a magnet. Some switches are proximity capacitance electric switches When the staff is mounted on a window with an end of the staff in abutment with the frame of the sliding portion of the window, the electrical contacts will be held open. Force applied by an intruder to open one sash of the window, will cause the electric contacts to close and set off the audible alarm. This alerts the homeowner or occupant of an attempt to force the sliding glass window open.

Another option is to include a motion sensing electric switch with the staff. The motion sensing device is activated whenever an attempt is made to force open a sliding glass window causing the locking device to move. The motion causes the contacts to activate the audible alarm. Another option is to substitute a pressure sensitive electric switch for the motion sensor.

The above and other novel features and advantages of the invention will be understood in more detail from the detailed description further below and the accompanying drawings.

DETAILED DESCRIPTION OF THE INVENTION

Figure 2:
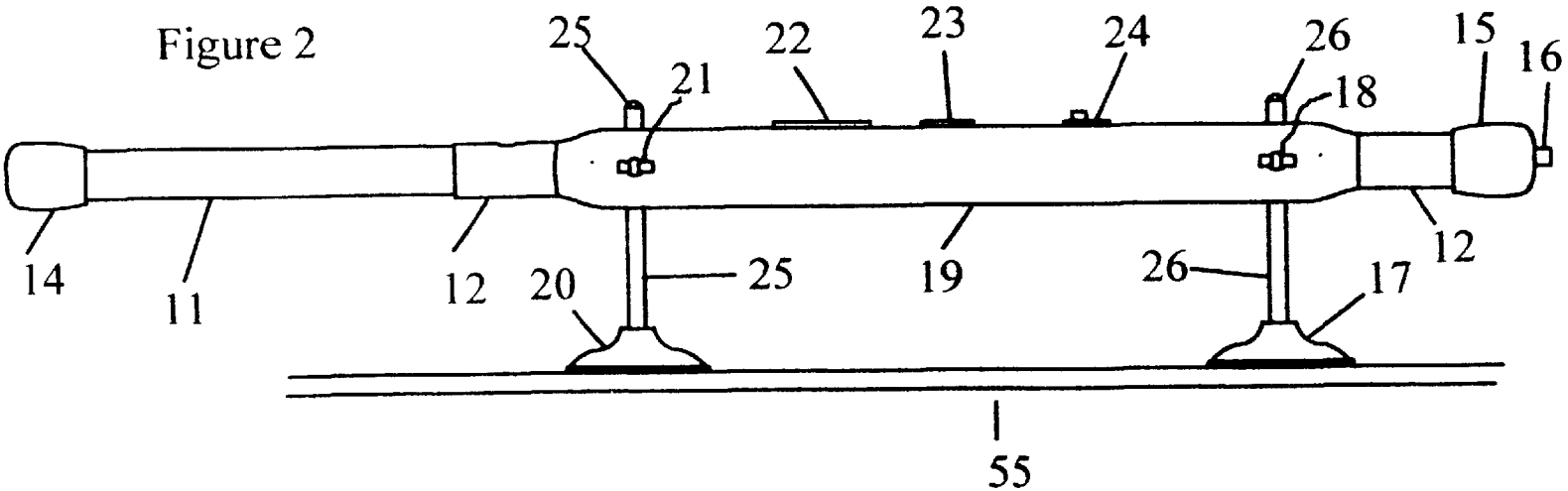
FIG. 2 is an edge view taken across the face of the window interior side.
Figure 1:
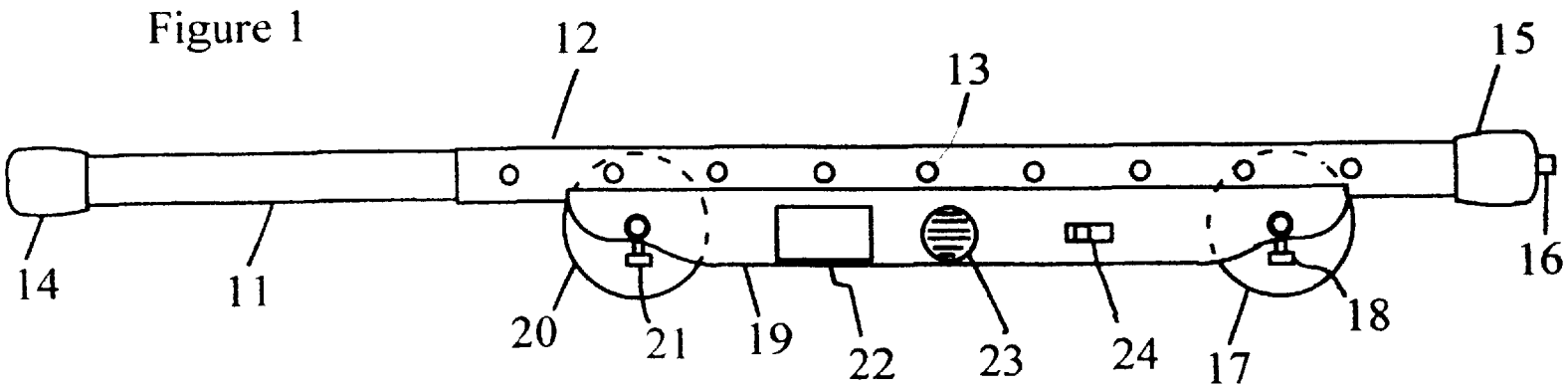
FIG. 1 is a full face view of a portable sliding window lock according to the invention, viewed from the interior of the room by a viewer looking toward the outside of the window.

A sliding window locking device is generally shown in FIGS. 1 & 2. The portable sliding glass window lock is comprised of a staff and a suction cup. The minimal structure required to block a sliding window comprises a compression column (the staff) and holding means (the suction cup). To that may be optionally added a series of enhancement features. The offset distance between the window glass surface and the staff axis can be varied by an attachment means between the staff and the suction cup which allows adjustment of offset distance. The length of the staff can be varied by a selection of means, e.g.: telescoping tubes with detent lock setting position; interchangeable inventory of screwed together staff extenders, lapping extender members held with clamping means, etc. Adjustable length includes the possibility of easily removing a single staff from an assembly that comprises a short collar open at both ends and having the collar equipped with clamping means to clamp to the main compression staff that is inserted as a new staff of a different length. Although one suction cup can be sufficient to hang the locking staff in effective operating position two suction cups may prove to be the more popular configuration since that lends additional rigidity of positioning. The duplication also lends a redundancy of holding power, although based upon actual observation the modern suction cup continues to hold fast without degradation by sunlight even after years of exposure while supporting a window display sign loading.

Staff end surface 14 and staff end surface 15 are the end points of a compression column that resist any effort by an intruder to force an entry opening in the window. Part 12 is connected to the suction cup attachment means part 17 through such intermediate parts as may be fabricated to effect a connection. In this instance of FIGS. 1 and 2 illustration the intermediate connecting parts are part 26 and part 19, with part 18 being a clamping means to control stand off rod extension length of part 26.

Part 11 is one member of the compression column staff and it provides an adjustable overall length for the staff by being adjustably joined to a second member of the compression column staff being part 12 in the drawing. Part 13 is one of an array of detent cavity position stops determining the overall length of the compression column staff. The position stop can be a detent recess for receiving a spring loaded shear pin or shear button, it can be a transverse shear pin across the staff, it can be a friction clamping means, a stepped half round thread arrest means, and a variety of variations known to the art. Parts 14 and 15 are the staff ends. Part 16 is the electric switching means signaling disturbance of the system by an intruder. Piece 17 is a suction cup for holding said staff to the window glass. Piece 18 is a holding means (e.g. a thumb screw or wing nut) for holding rod piece 26 at a selected extension value, positioning staff members piece 11 and piece 12 an appropriate offset distance away from the window glass. Piece 19 is a mounting shelf or shell or side extension of staff member piece 12. Thus piece 19 (which may be an integrally formed portion of piece 12) serves to provide attachment space for piece 18 holding screw, piece 26 which is rod piece holding suction cup 17 to staff member 12. Piece 20 is a duplication of piece 17 in a situation that more than one suction cup is chosen for holding the invention sliding window lock in place on the window glass. Similarly piece 21 is a duplication of piece 18.

Piece 22 is a battery case in the event that the invention is fabricated to comprise electric activation means. Piece 23 is an alarm sounding device such as a buzzer. Piece 24 is an electric switch for disabling the alarm circuit. Piece 25 is a duplication of piece 26 for a redundant suction cup.

To use the staff piece 12, some means must be provided for securely fastening it to a window surface where it will not become easily dislodged. To accomplish this, a suction cup piece 17 is fastened to horizontal surface 55. Suction cup 17 may include a release tab for removing the portable sliding door lock whenever the owner moves to other rental quarters or whatever. A quick pull on release tab will break the vacuum of suction cup 17 on a vertical surface allowing the sliding glass door locking staff to be easily removed.

Figure 3:
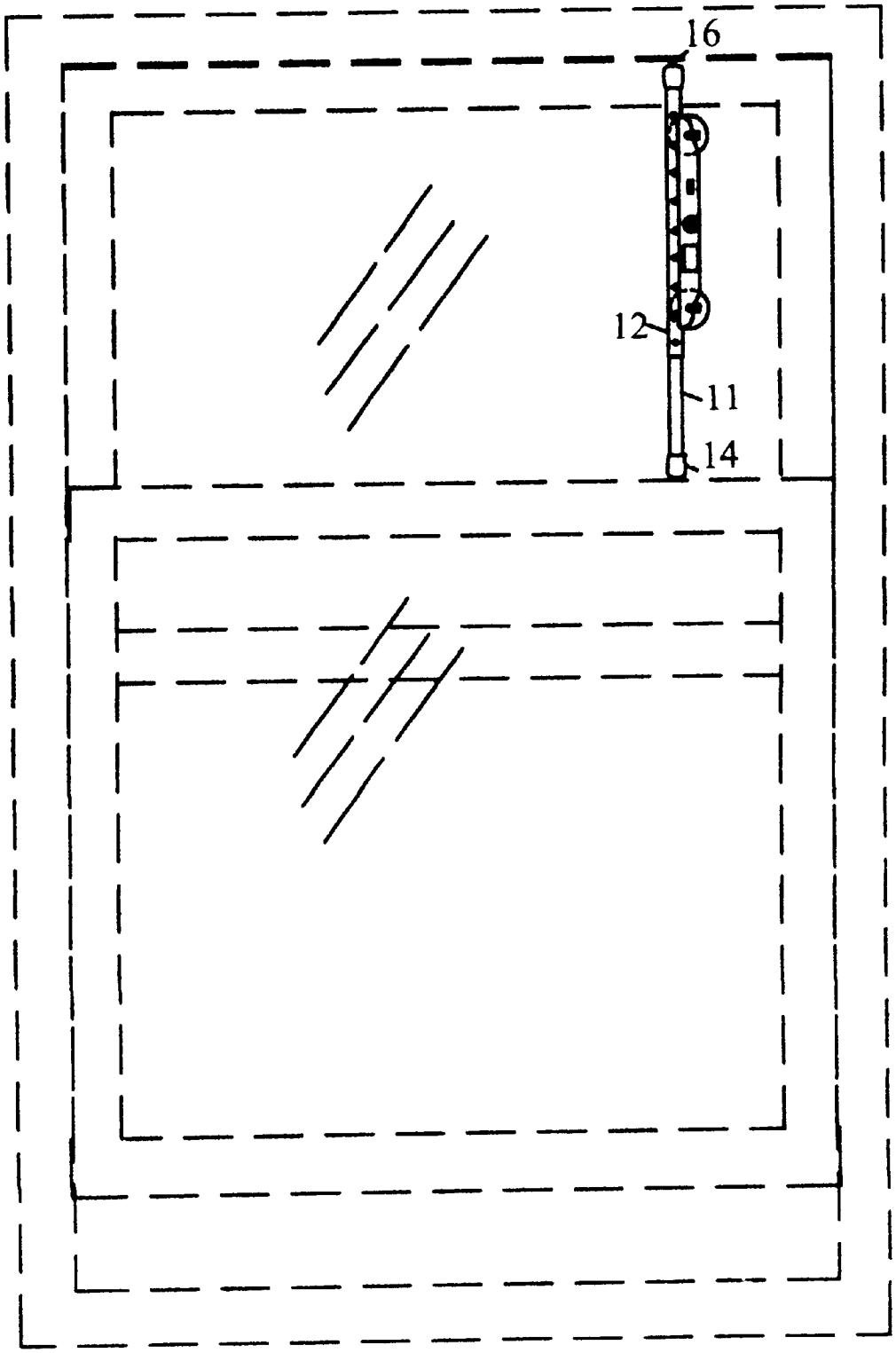
FIG. 3 is a view of the sliding window lock invention in position on a window.

Suction cup 17 is securely attached to holding means 12 as illustrated in the FIGS. 1, 2, and 3. Mounting of said portable sliding window lock of FIGS. 1, 2, and 3 and its operation are illustrated in FIG. 3. The window illustrated is the common double-pane type found in many homes. Portable sliding glass window lock is positioned on the flat surface of fixed window piece 55 and pressed firmly to compress suction cup 17 creating a vacuum to securely adhere to the surface of window 55. It can help to slightly moisten suction cup 17 to assure the integrity of the seal. Said portable sliding window lock can be positioned anywhere on the surface of fixed window 55 depending upon how far the user desires a sliding window to open.

Said portable sliding window lock can be used on vertical or horizontal windows. Vertical sliding window placement is illustrated in FIG. 3 such as those found in most homes or recreation vehicles. Generally sliding windows have a double-pane upper window and lower sliding window. Sliding window is opened by raising it as illustrated in FIG. 3. Once sliding window is opened it can be easily opened further from the outside by simply pushing the window up as illustrated. Thus, an intruder can easily gain access by raising sliding window and climbing through the opening. There have been reports of such access being gained. However, this can be quickly, easily and effectively prevented with the instant invention of a portable sliding window lock.

Once said portable sliding window lock is securely fastened to surface window sash, it will further prevent opening of sliding glass window as illustrated in FIG. 3. The user can set the open position of sliding glass window by adjusting staff piece 11 where it is held by staff piece 12. Piece 14 acts against further movement of the window frame. Once said sliding window lock is securely fastened to glass window surface 55 of fixed window, sliding glass window is opened until frame abuts surface 14. This fixes the open position of sliding glass window. Any attempt to force sliding glass window open has the action blocked by said staff.

As an optional embodiment, an audible alarm may be included as illustrated in the view of FIGS. 1, 2, and 3. Audible alarm 23 may be a battery-operated siren-type alarm that can be of any suitable design. It is mounted on the surface of piece 19.

Audible alarm 23 is activated by electric switch 16 associated with parts 15 and 12. Electric switch 16 is comprised of a pair of contacts.

When portable sliding window lock, with audible alarm part 23, is installed on a double sash window, both of which are capable of being slid, downward movement of the upper sash forces lower sash down and also pulls electric switch 16 away from its force against the upper frame inside. The electric switch button piece 16 extends. This will close electric switch 16 activating audible alarm alerting an occupant of an attempted break-in. It will also probably frighten and scare away the potential intruder.

Another option for the audible alarm portable sliding window locking device, is to provide a motion sensing device to activate audible alarm. In this embodiment, a motion sensing device is mounted on said staff and connected to audible alarm 23. Once the portable sliding window lock with an audible alarm is installed, it will be activated by any attempts to open the sliding window causing the portable sliding window lock to move. Optionally, sensing device could be a strain gauge type electric switch that senses the window frame being forced against the blocking action of said staff.

Thus, there has been disclosed, a unique portable sliding window locking device that is safe and easy to use. It can be easily and quickly installed on a vertical window surface to hold a sliding glass window in a partially opened position selected by the user. It effectively locks sliding glass windows against being forced open when they are ajar preventing unauthorized access by intruders. In an optional embodiment an audible alarm is provided that is activated when any attempts are made to open a sliding glass window.

The third drawing sheet presents FIGS. 4, 5, 6, 7, 8, 9, and 10.

Figures 4, 5, 6, 7, 8, 9, 10:
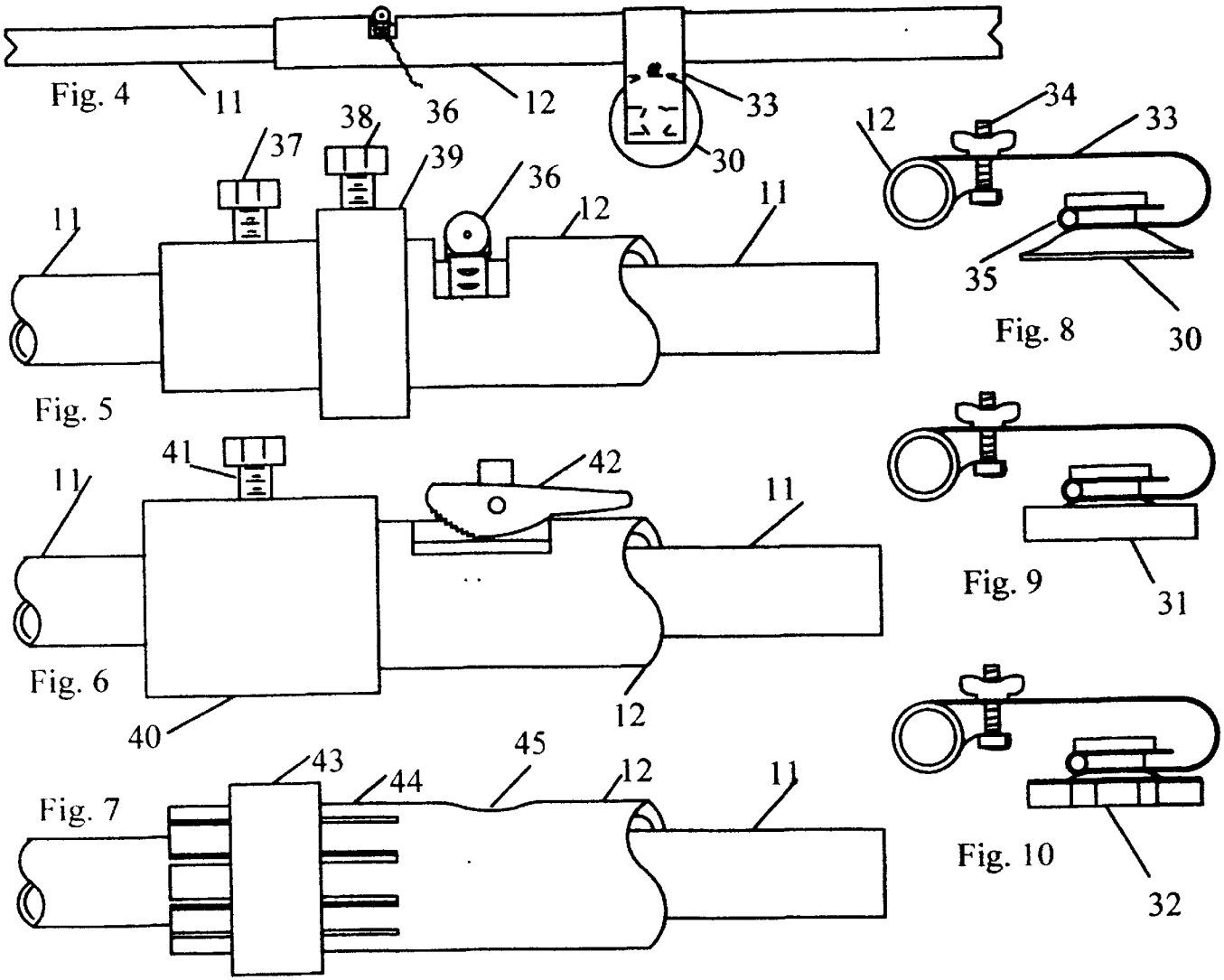
FIG. 4 is a view of a staff comprising two tubular members slipped together to make a staff of adjustable length, and comprising staff length clamping means and suction cup mounting means.
FIG. 5 illustrates three different designs of a staff length clamping means of which one is a hose clamp, another is a set screw and a third is a collar with a set screw.
FIG. 6 illustrates two different clamping means of which one is a rocker with cutting burr to immobilize one staff member within the second staff member to fix the total staff length and the other is a pipe coupling with a set screw penetrating to the interior staff member to immobilize same.
FIG. 7 illustrates two different clamping means of which one is a collet chuck holder and the other is an eccentric interference fit engaged by rotating one staff member within the other staff member.
FIG. 8 illustrates a simple means for fastening a suction cup to a staff member with adjustable offset means, offset amount adjustment being made by bending the looped metal holding strap.
FIG. 9 illustrates a simple means for fastening just anything else to a staff member that can contribute to the functionality of the system.
FIG. 10 illustrates a simple means for fastening a plurality of functional means to a staff member that can contribute to the total functionality of the system.

FIG. 4 suggests the components that might comprise the bare minimum of parts to constitute the invention. There are two compression column means, parts 11 and 12. There is a suction cup holding means part 30. There is clamping means designated part 36.

FIGS. 5, 6, and 7 illustrate seven different clamping concepts. In FIG. 7 the depression region serves to point out that two staff members can be locked together by a rotational manipulation which brings the two staff members into an interference fit with one another. FIG. 7 also illustrates a collet chuck holding means where ring 43 is moved against tapered profile finger jaws 44 to grip piece 11.

FIG. 6 shows two more different means for clamping the two staff members together in adjustable, stepless positioning. Part 40 is a pipe coupling attached to part 12. Clamping screw 41 is screwed down to clamp against part 11. Part 42 shows another variation of clamping means. Part 42 is a lever with eccentric end contour that bites into part 11 to hold part 11 fast.

FIG. 5 has three different clamping means illustrated. Assuming the thickness of part 12 to be great enough and strong enough, a thread tapped into part 12 to receive screw 37 is sufficient to clamp part 12 to part 11. Alternately as separate metal collar 39 with threaded screw member 38 can press through part 12 to clamp against part 11. Part 36 makes a sturdy, low profile clamping means. Part 36 is the common hose clamp band that is tightened by a rotating worm gear pulling on the gear rack configuration of half elliptical cuts in the encircling band. Part 36 as portrayed clamps only on part 11 but since it is lodged in a half circumference cut in part 12 that part 36 immobilizes part 11 within part 12.

FIG. 8 shows one of a multitude of possible ways to attach suction cup 30 to staff member 12. Part 33 can be a metal band (or plastic or whatever) encircling part 12, clamped tightly by screw part 34, looped back to attach by securing means 35 to hold fast suction cup 30. Assuming the part 33 to be half hard spring type metal it then permits some deformation by bending beyond the yield point to adjust to establish a selected offset distance of the staff 12 from the window glass surface.

FIG. 9 part 31 we define to be an electric battery, a solar cell, a solar cell with a rechargeable battery or any power means of a similar genre.

In FIG. 10 we define part 32 to be a wireless transmitting means, a wireless receiving means, a wired connector means, a smoke detector, a carbon monoxide detector or just whatever may suit the fancy of the full building protection system.

In other words, we have here in this simple, inexpensive adjustable open window lock device the anchorage point for a very sophisticated, whole house security protection system. Barrier windows typically have the benefit of exposure to daylight and often to sunlight. With modest energy storage means in proximity we have 24 hour independent power source. By adding a wireless transmission chip we have a tie in to the total building security signal grid. The system is portable. The system is expandable from an initial useful modest functional beginning. The system can be neglected (i.e. no annual battery changing required) and still provide safety service. The system can link to phone dial up means to bring emergency back up help. The system offers redundancy for enhanced reliability and protection against circumvention by an intruder. The system can anticipate build up of explosive gas or fume mixtures, toxic systems, unusual thermal excursion. With microprocessor logic on minuscule chip systems coordinated with the full house sensor system, occupancy patterns and unusual distress patterns can be identified and signaled to a follow up watch station, achieving as good a protection as the more expensive continuous human monitoring of a television display array.

Although to some extent the description and the drawings seem to or in fact do portray a staff comprised of two tubular members it should be obvious that two structural members of almost any cross sectional profile can be lapped and linked together to form a staff of an adjustable, selected length to provide means with which to practice the invention disclosed in this petition for letters patent.

FIG. 3 shows the invention installed in a double hung window where both sashes are moveable. Many of such old windows had counterweights and sash cords. If the intruding person on the outside of the window were to push the top sash down the window lock staff would be carried down by virtue of its being connected to the upper sash glass via a suction cup attachment. That movement activates the alarm button switch at the top. That movement also closes the lower sash ventilating gap just as fast as a gap opens at the top. Thus the prospective intruder still does not achieve an opening large to make body entry.

Many modern windows have mobility only in the lower sash. (Window washing is performed by a mechanism that allows the lower sash to be hinged out of its vertical track.) With such a single moveable sash window our alarm switch would be ineffective as portrayed in FIG. 3. There are several ways to achieve the benefit of an activated alarm switch without a requirement of mobility in the upper sash. Motion switch activation requires only the disturbance caused by the movement of a human body.

A vibration switch can respond to any agitation of the window glass. An even simpler and easier design to implement is to allow a short movement degree of freedom in the lower staff segment and allow gravity or light spring movement to cause the staff segment to activate a switch.

If the set screw 38 of collar 39 of FIG. 5 rides in a short vertical slot in piece 12 then piece 11 can undergo a slight movement relative to piece 12, carrying with it the collar. Same movement analysis applies to hose clamp piece 36. That movement is enough to activate a switch mounted on piece 12. Various switch arrangements can serve the purpose. For example a reed switch activated by proximity of a magnet can close (or open) as a magnet passes by, making its approach either by descent or ascent along staff piece 12. Thus with the window set ajar for ventilation, with staff clearance sufficient for opening another half inch or full clearance for closing, a movement of a half inch either up or down could be sufficient to trigger the alarm.

Carrying the analysis further we describe an alternate alarm system that is not dependent upon electric switching means. To visualize the basic concept, consider a spring mouse trap mounted on staff 12. A thread from the bait holder to an anchorage point on part 11 or on a fixed point of the window frame would suffice to spring the trap. With some noisy bangles dangling from the trap hoop we have an alarm sounder that is not dependent upon maintenance of electric battery means.

This invention is not to be limited by the embodiment shown in the drawings and described in the description which are given by way of example and not of limitation. Rather the scope of the invention is in accordance with the scope of the appended claims read with the broad instruction of the rest of the petition for letters patent.

Correlation of Description Vocabulary With Claims Vocabulary

The term "portable device" signifies that on occasion of washing windows or on occasion of moving new rental quarters the apparatus comprising the invention can be quickly and easily detached from the real estate structure.

Sliding windows come in both very old and of modern designs, some with two moving sashes and some with one fixed and one sliding. The invention is serviceable for all such window types. When the window is used principally as a solar energy location the closure locking design object may be irrelevant.

The term "staff" used to designate a locking column is a compression member of any of a variety of structural cross sections. "Staff" may also designate a means providing a support attachment point for other structures and means.

The term "temporary" signifies that on occasion of washing windows or on occasion of moving to new rental quarters or on occasion of repair or upgrade of the invention, the apparatus comprising the invention can be quickly and easily attached to and detached from the real estate structure.

The term "moveable" in relation to window sashes includes the illustration function in the drawing with the realization that some features of the invention do not require mobility of the glass supporting the invention.

The term "adjustable length" includes any means of joining two structural members and includes any practical means for substituting a new shorter or longer compression column to an aggregate assembly that comprises the remainder elements of the invention.

The term "mounted" as used to indicate the function of a suction cup requires no clarification of the term suction cup. However the term mounted without more can include means such as spring clips, magnetic fasteners, hooks, Velcro, snaps, adhesives and others of a wide variety of fasteners.

The term "alarm" can comprise any energy transfer means that triggers a remote response to a system excursion condition.

The term "switch" or "electric switch" designates any device which responds to energy input event with an action of changing the state of an electric system.

The term "motion sensing" has a great range of embodiments including the currently popular design of an electret fabricated from Kynar film responding to a change in amount of impinging infrared radiation.

The term "rechargeable electric storage means" includes rechargeable batteries (electrochemical cells) and includes capacitors (electrostatic charge on conductors separated by electric material).

The terms such as solar cells, sensors, wireless or radio equipment, smoke detectors, voice recognition means and many more of such electronic technology terms are well known in the contemporary vocabulary so as not to require separate elucidation as to reference herein.

We claim:

1. A portable device for locking a double hung sliding window comprising a staff serving as a compression column and said device comprising a suction cup as fastening means mounted on said staff to position said staff between a lower moveable frame sash portion of a sliding window and a second upper frame portion of the double hung sliding window whereby said staff acting as a compression column can be mounted in proximity to the glass of a sliding glass window to intercept the lower moveable frame sash and lock the lower moveable frame sash portion to a fixed small limited opening position and said portable device comprising at the top end an electric switch which is held electrically open by resting against the top of the fixed immobile window frame such that lowering the upper window moveable frame sash allows said electric switch to close electrically thereby sounding an alarm associated with said electric switch.

2. The portable device of claim 1 wherein said staff is of adjustable length, such as to enable said sliding glass window to be completely locked closed and said staff may lock said sliding glass window in partially open positions of such positions as may be selected in use.

3. The device according to claim 1 in which said means for activating said alarm comprises a motion sensing electric switch.

4. The device according to claim 1 in which said means for activating said alarm comprises a vibration sensing electric switch.

5. The device according to claim 2 having clamping means to fix the length of said staff wherein the length clamping means is a spring loaded detent button positioned as a shear pin from one portion of said staff into a shear pin hole in the second portion of said adjustable length staff.

6. The device according to claim 2 having clamping means to fix the length of said staff wherein the adjustable length clamping means is a metal collar with a set screw.

7. The device according to claim 2 having clamping means to fix the length of said staff wherein the length clamping means comprises a set screw threaded into one member of said staff.

8. The device according to claim 2 having clamping means to fix the length of said staff wherein the length clamping means is a metal band hose type clamp.

9. The device according to claim 2 having clamping means to fix the length of said staff wherein the length clamping means comprises an eccentrically pinned lever with a rocker curved burr that digs into the moveable introduced portion of the staff member to thereby lock the assembly to a fixed overall staff length.

10. The total device identified in claim 1 with wireless transmitter means and in location separate therefrom having a wireless signal receiver means such that said wireless transmitter means communicates with said wireless signal receiver means.

* * * * *